United States Patent [19]

Overton, Jr.

[11] 4,146,017

[45] Mar. 27, 1979

[54] HOOD SYSTEM FOR COOKING EQUIPMENT

[76] Inventor: Duncan E. Overton, Jr., 719 Luttrell St., Knoxville, Tenn. 37917

[21] Appl. No.: 822,727

[22] Filed: Aug. 8, 1977

[51] Int. Cl.[2] ..... F21C 15/08; F24C 15/20

[52] U.S. Cl. ..... 126/299 D; 55/DIG. 36

[58] Field of Search ..... 126/299 D, 299 E; 55/DIG. 36

[56] References Cited

U.S. PATENT DOCUMENTS

| | | | |
|---|---|---|---|
| 3,457,850 | 7/1969 | Sweet et al. | 126/299 D |
| 3,530,784 | 9/1970 | Courchesne | 126/299 D |
| 3,645,194 | 2/1972 | Awlrich | 126/299 D |
| 3,664,255 | 5/1972 | Kuechler | 126/299 D |
| 3,890,887 | 6/1975 | Kaufman | 55/DIG. 36 |
| 3,978,777 | 9/1976 | Nett | 55/DIG. 36 |

*Primary Examiner*—Ronald C. Capossela
*Attorney, Agent, or Firm*—Fitch, Even, Tabin & Luedeka

[57] ABSTRACT

A system for the capture and withdrawal of cooking vapors from above a cooking surface disposed in a room, such as a kitchen, comprising hood means disposed above the cooking surface, means for introducing air from outside the room through an inlet into the space between the cooking surface and the hood to entrain the vapors from the cooking surface, and filter means disposed within the space between the hood and the cooking surface at a vertical height less than the vertical height of the air inlet means for receiving vapor-ladened air and exhausting the same after filtration thereof.

5 Claims, 3 Drawing Figures

HOOD SYSTEM FOR COOKING EQUIPMENT

This invention relates to the capture and exhaust of smoke, grease-laden fumes, etc., emanating from cooking equipment, and particularly to hood systems positioned above a cooking surface for exhausting such fumes, smoke, etc.

It has long been desired that all smoke, fumes, etc., emanating from a cooking surface such as in a commercial kitchen or the like be captured and exhausted from the kitchen or other room within which the cooking surface is disposed, with minimum escape of the fumes, etc. into the kitchen area. Heretofore, there have been provided hoods with exhaust fans that pull air from the kitchen or other room, into the hood where the moving air entrains the smoke, fumes, etc., emanating from the cooking surface, with the air and the entrained fumes being thereafter exhausted to the atmosphere externally of the room. This prior art concept if of simple construction, thereby involving relatively low costs for initial manufacture of the equipment, its installation and operation. In this prior art device, however, all of the air passing through the hood is drawn from the interior of the room so that if this air has been tempered, i.e. heated or cooled, there is a substantial energy loss, and resultant economic loss, by reason of this tempered air being pulled from the room and exhausted to the atmosphere.

To minimize the loss of tempered air, it has been suggested that the volume of air pulled from the room and through the hood be minimized. This economy measure has been found to result in inadequate velocities such that grease entrained in the flowing air is not completely exhausted, but rather, the grease deposits on the interior walls of the hood and/or ductwork due to the low velocity of the air flow. This, among other things, has led to the establishment of minimum air flows through hoods. For example, various fire protection agencys have established a minimum standard of air flow through a hood of 100 cu. ft. of air per sq. ft. (cfm/sq. ft) of hood face entrance area for wall mounted hoods and 150 cfm/sq. ft. of hood face entrance area for island style hoods. Employing the prior art concept of pulling air from the room through the hood to the atmosphere, at a velocity that will meet the minimum standards referred to above, the result is a flowing air stream that uses enormous amounts of energy.

It has also been suggested heretofore to bring in air from outside the room or building ("make-up" air curtain) and introduce the same into the space surrounding the hood and the cooking surface in an attempt to reduce the amount of tempered air extracted from the room. One of the major problems involved in this concept is inadequate entrainment of the smoke, fumes, etc., emanating from the cooking surface. One concept has proposed to jet the incoming air toward the cooking surface from whence it is withdrawn through the hood. This and similar concepts have resulted in inordinate cooling of the cooking surface by reason of the air passing thereover. Other problems associated with this concept involve slow and/or indirect movement of the vapors to the filter such that grease in the vapors cooled and deposited on the walls of the hood, etc. thereby developing a situation that is unsanitary, unsightly and a potential fire hazard. Still further, these prior art devices tended to blow the make-up air onto a user of the equipment with resultant discomfort.

Commercial or industrial cooking facilities such as ovens and steamers are termed "high profile" cooking equipment, and ranges, char broilers, and deep fat fryers are termed "low profile" cooking equipment in that the latter commonly introduce relatively greater volumes of grease and smoke into the atmosphere. Hence heretofore it has been common to position a hood closer to the cooking surface of the equipment in the case of the "low profile" equipment to ensure capture of the exhaust gases without their escape into the room that contained the equipment. In those prior art devices, known to applicant, that were used with low profile cooking equipment, it is not common to use make-up air due to the problems associated with the introduction of the air, from a physical standpoint i.e. size and shape of equipment, from an air flow control standpoint, etc. Also there has existed the problem of user discomfort due to the flowing air.

In accordance with the present disclosure, there is provided a system for the withdrawing of cooking vapors from above a cooking surface disposed in a room or the like, comprising a hood disposed above the cooking member. The hood preferably has a horizontal cross-sectional area substantially equal to the horizontal cross-sectional area of the cooking surface so that the hood substantially covers the area of the cooking surface. The hood is spaced apart from the cooking surface so that there is defined between the hood and cooking surface an open space. A substantial portion of the peripheral edge of the hood defines an air inlet through which air is introduced to the space between the hood and the cooking surface. The air for instruction into this space is drawn from outside the room, and preferably from the ambient atmosphere outside the building. Within the hood and in the space between the hood and the cooking surface, there is provided a filter at a vertical height that is less than the height of the air inlet means above the cooking surface. The air introduced into the space through the air inlet is directed toward the filter. In the preferred embodiment, the air is injected into the space along an inwardly and downwardly oriented path toward the filter. The velocity of the air entering the space is not sufficient to allow the air to reach the cooking surface before it is withdrawn from the hood through the filter by an exhaust fan.

In a preferred embodiment of the present system, the quantity of air exhausted from the hood through the filter is greater than the quantity of air entering the space between the hood and cooking surface by at least about 10 percent and not more than 50 percent. By this means, there is assurance that fumes will not escape capture and eventual exhaust through the hood. This relatively small quantity of air drawn from the room minimizes the economic loss and other undesirable effects such as drafts.

It is therefore an object of this invention to provide an improved system for the capture and exhaust of vapors emanating from a cooking surface. It is another object to provide a system of the type disclosed wherein there is minimal removal of tempered air from the room that contains the cooking equipment. It is another object to provide a system of the type described wherein air is drawn from a source outside the room containing the cooking surface and directed into a space between a hood and a cooking surface along an inwardly and downwardly oriented path to a filter that is disposed at a vertical height above the cooking surface less than the vertical height of the inlet above the cooking surface.

Other objects and advantages of the invention will be recognized from the following description, including the drawings in which.

Figure 1:
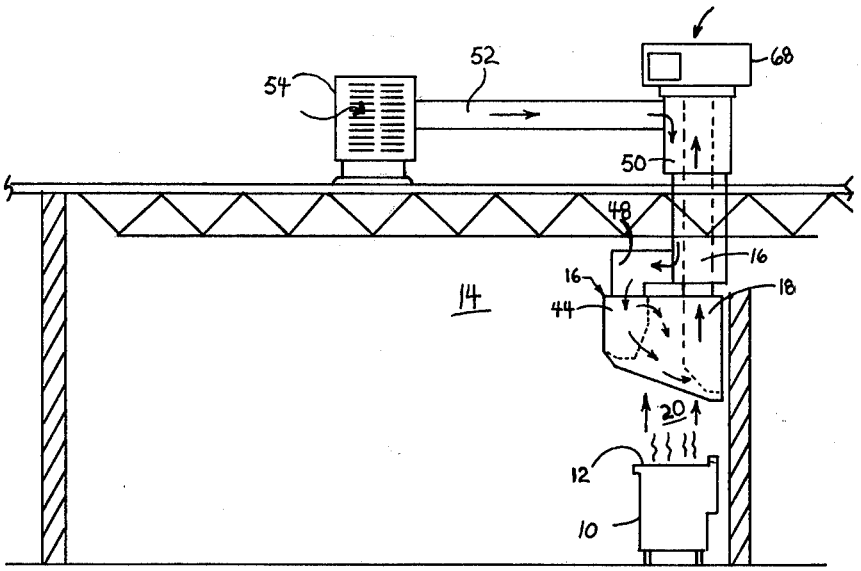
FIG. 1 is a schematic representation of a system employing various features of the invention.

Referring now to FIG. 1, there is disclosed a typical appliance 10 having a cooking surface 12 from which vapors emanate during a cooking operation. In the depicted embodiment, the appliance is disposed within a room 14 such as a kitchen or the like.

There is mounted above the cooking surface 12 a hood means 16 comprising a housing 18 of generally rectangular horizontal cross-section. The horizontal cross-sectional area of the hood 16 is substantially equal to or greater than the corresponding cross-sectional area of the cooking surface 12 so that the hood substantially covers the cooking surface 12.

As shown in FIG. 1, the hood is spaced above the cooking surface to define an open space 20 therebetween. The hood 16 generally comprises a cover 22 (see FIG. 2) a rear wall 24, side walls (23 and 25) and a forward wall 26, the bottom of the hood being open.

Figure 2:
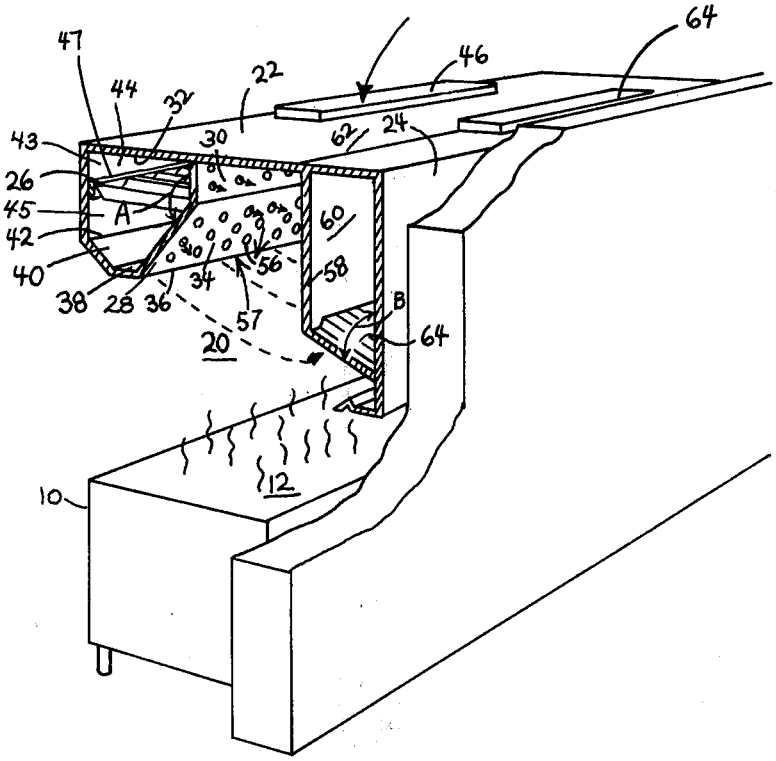
FIG. 2 is a schematic representation, partly fragmentary and partly cut-away, of a hood and cooking surface as employed in the disclosed system.
Figure 3:
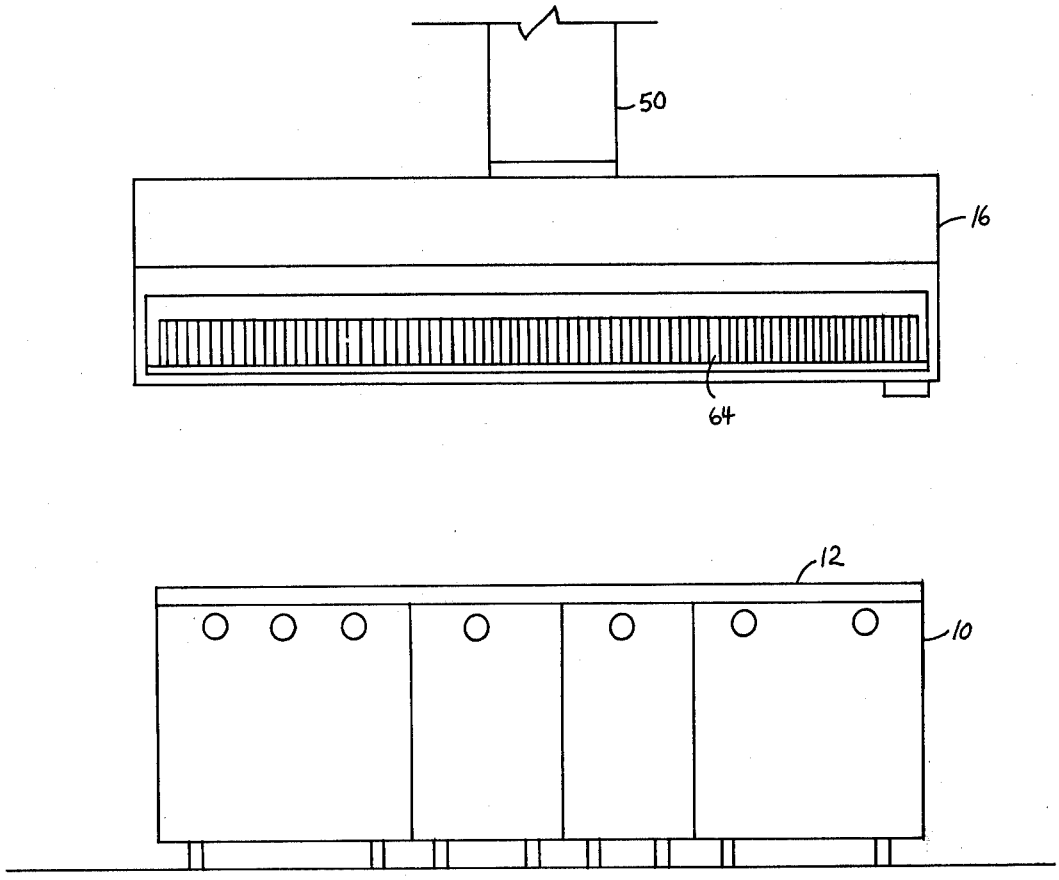
FIG. 3 is a front elevational view of a system as shown in FIG. 2.

Internally of the hood, there is provided a partition 28 comprising a first perforated planar panel 30 that extends from a point of attachment with the bottom surface 32 of the cover 22 vertically downwardly to join a second planar panel 34 which is angled from the first panel outwardly of the hood as best seen in FIG. 2. In a preferred embodiment, the angle formed between the panels 30 and 34, i.e. angle "A," is greater than 90 degrees and less than 180 degrees so that the panel 34 is inclined with respect to both the vertical and the horizontal. The lower edge 36 of the panel 34 joins a further and non-perforated planar panel 38 which in turn is joined to a still further non-perforated planar panel 40 that is joined to the bottom edge 42 of the front wall 26 of the hood. In this manner, there is formed along the forward edge of the hood a plenum 44. This plenum 44 is connected through an opening 46 to a duct 48 (see FIG. 1), which in turn is connected through ducts 50 and 52 to an intake fan and filter assembly 54 that is disposed exteriorally of the room 14 for collecting and moving air from outside the room through the ducts 52, 50, and 48 into the plenum 44. The panels 30 and 34 of the partition 28 are provided with a plurality of perforations 56 so that these panels define an inlet 57 for the introduction of air from outside the room 14 to the space 20 between the hood and the cooking surface 12. In the drawings, the size of the individual perforations 56 is exaggerated for purposes of illustration. In a preferred embodiment, the individual perforations are circular and about 3/16 inch in diameter.

The plenum 44 is divided into an upper portion 43 and a lower portion 45 as by an opposed blade damper 47 of the type available from Reliable Metal Products of Geneva, Alabama. By means of this damper, the incoming air flow is redirected toward the space 20 and selected portions thereof are caused to exit the plenum through the perforations in each of the panels 30 and 34. That is, more or less air is caused to exit through each panel. In one embodiment, the individual blades of the damper are adjustable in groups along the length of the damper to adjust the volume of air entering the space 20 from one end of the hood to the other end thereof.

Still further, interiorally of the hood there is provided a further partition 58 comprising a first panel 60 that depends from the lower surface 32 of the cover 22 generally vertically downwardly within the hood so that in combination with the cover 22 and the rear wall 24 of the hood, there is defined an exhaust plenum 62 that extends along the rear wall of the hood. The bottom of this plenum 62 is closed as by one or more filters 64 that are mounted in this bottom opening. As seen in the several figures, the filter 64 is peferably inclined at an angle "B" with respect to the vertical so that the exposed face 65 of the filter receives thereagainst the incoming air as admixed with tempered air from the room and with entrained vapors from the cooking surface.

In the preferred embodiment, and as illustrated in the several figures, the vertical height of the perforated panels 30 and 34 of the partition 28 is greater than the vertical height of the filter 64. This positions the inlet 57 higher than the filter 64. Further, as noted above, the angular disposition of these panels is chosen such that air entering through the perforations 56 in the panel 34 is directed inwardly and downwardly of the hood into the space 20 between the hood and the cooking surface and generally toward the filter 64. As further noted above, the angular disposition of the filter 64 is such as to receive the incoming air against the face of the filter 64. Simultaneously, outside air enters the top interior area of the hood through the perforations 56 in the panel 30 to fill and sweep this area of vapors.

The exhaust plenum 62 is connected through an opening 64 to a duct 66, thence to an exhaust fan 68 that preferably is disposed exteriorally of the room 14 to exhaust the air from the hood to the atmosphere outside the room.

It will be recognized that the system shown in the figures is a "wall-type" system in which the rear wall 24 of the hood lies aganist the room wall and the hood projects from the wall in a cantilevered fashion over the cooking equipment. It will be readily recognized by a person skilled in the art that two of the hood systems shown in the figures and described herein can be placed back to back and suspended from the ceiling or the like to provide an "island style" system. The function and operation of the system is identical in either the wall style or island style system, the island style merely comprising a duplication of components.

It has been found that the present system accomplishes essentially complete entrainment of the cooking vapors without their escape into the adjacent room while minimizing the withdrawal of tempered air from the room. Contrary to the prior art devices which employ the use of "make-up" air from outside the room, the present system does not interfere with the accessibility to the cooking surface by an employee nor does the flow of the make-up air create a discomfort to the employee. Among other things, these advantages are accomplished in the present system by positioning the filter, hence the exhaust outlet of the hood, relatively close to the cooking surface and at a location across the cooking surface from the position of a user of the equipment so that the filter is relatively close to the cooking surface where the vapors are generated but out of the way of the cooking operation and/or the user. Contrary to the prior art devices, in the present system the make-up air is introduced into the space between the hood and the cooking surface in a diffuse manner, i.e., through a plurality of perforations 56, and along a path that is oriented inwardly of the hood and downwardly across the cooking surface with the path terminating at the filter that is disposed at a lower vertical height above the cooking surface than the height of the air inlet. By reason of this arrangement of the elements of the present system, the velocity of the tempered air drawn from the room into the space between the hood and the cooking surface and eventually exhausted through the filters is relatively great in the area immediately adjacent the hood and cooking equipment by reason of the minimizing of the open area between the hood and cooking surface. This velocity of the flow of the tempered air from the room, however, reduces precepitiously as the distance increases away from the hood and cooking equipment. This produces the desirable result of being able to use relatively low volumes of make-up air and low volumes of tempered air while the respective velocities of the make-up air and the tempered air are maintained relatively high. The result has been found to be an almost immediate entrainment of cooking vapors as they emanate from the cooking surface, with the entrained vapors being conveyed quickly to the filter before the greases, etc., in the vapors can cool and deposit on the walls of the hood etc. Rather, the greases are trapped in the filter as is desired and the other vapors are exhausted from the hood to the atmosphere outside the room.

It further appears that in the present system the introduction of make-up air into the space between the hood and cooking surface and through differently oriented perforated panels 30 and 34 generates different air flow patterns within the space such that the upper interior area of the space 20 is filled with make-up air and the same area is swept clear of vapors etc., such sweeping action apparently tending to prevent vapors from accumulating in the upper interior of the hood where they have time to cool and condense grease, etc. onto the hood walls. The second flow path of the air, i.e. the air entering the space 20 through the perforations in the panel 34, is along a path directed inwardly of the hood and downwardly across the cooking surface with the path intercepting the face of the filter 64. This flow of air appears to develop a type of air curtain that intersects the upwardly flowing vapors from the cooking surface to entrain the vapors and sweep them toward the filter 64. These desirable results have been found to occur when the filters are within about 36 inches above the cooking surface and the air inlet is at a greater height from the cooking surface. e.g. about 41 inches from the cooking surface to the lower edge of the air inlet 57. Not only does this physical arrangement provide for desired air flow, it also provides for ready and unobstructed accessability to the cooking surface by a user. As noted hereinabove, by means of the damper 47, the relative quantities of air exiting the plenum 44 through the panels 30 and 34 is selectable to effect the desired air flow patterns within the space 20. The selection of these air flows is accomplished in the field after installation of the system to accommodate the extant room air flow patterns and either actual or anticipated vapor generation.

In one specific embodiment, a hood six feet in length and four feet from its front wall to its rear wall was positioned above a cooking surface with the filter of the system being spaced approximately 24 inches above the cooking surface. The inlet 57 for the make-up air in this embodiment comprised the panel 30 having an area of 864 sq. in., and the panel 34 having an area of 1080 sq. in. The angle "A" between these two panels was 135 degrees. The lower edge of the panel 34 was 41 in. above the cooking surface. The straight line distance between the center of the panel 34 and the center of the filter 64 was 52 in. The make-up inlet 46 to the plenum 44 was twelve inches wide and 26 inches long. A supply fan having a capacity of about 1260 cfm per minute was connected to the duct 52 to supply air to the plenum 44. It will be recognized that the velocity of the air moved into the hood by the supply fan was substantially reduced as the air entered the plenum 44 and was distributed along the length thereof prior to its exiting the plenum 44 through the perforations 56.

In this specific embodiment, the exhaust fan 68 had a capacity of about 1800 cu. ft. per minute of air flow and was connected through the duct 62 to the exhaust opening 64 which was 10 in. wide and 18 in. long. A 24 inch × 12 inch filter having an exposed face area of 288 sq. in. was mounted in the open end of the exhaust plenum at an angle "B" of 45 degrees with respect to the vertical.

The volume of air introduced into the space between the hood and cooking surface was about 70 percent of the total volume of air exhausted by the exhaust fan 68. The make-up air entered the space 20 in a plurality of streams through the perforations 56 in the panels 30 and 34. The perforations 56 occupied about 60 percent of the area of these two panels, each perforation being about 3/16 inch in diameter. The static pressure loss through the hood was about 1 inch water gauge.

In this embodiment, relatively heavy smoke emanating from the cooking surface was quickly and effectively captured without escape into the room and was fully exhausted through the filter. No user discomfort due to drafts was experienced. No substantial quantities of grease or other condensibles were noted to collect on the hood or duct walls, but rather such were collected by the filter.

While a preferred embodiment has been shown and described, it will be understood that there is no intention to limit the invention by such disclosure, but rather, it is intended to cover all modifications and alternate constructions falling within the spirit and scope of the invention as defined in the appended claims.

What is claimed:

1. A system for the capture and withdrawal of cooking vapors from above a cooking surface disposed in a room or the like comprising hood means disposed above said cooking surface, said hood means being at least substantially equal in horizontal cross-sectional area to the horizontal cross-sectional area of said cooking surface and including a peripheral edge defining an entrance into the interior of said hood, said hood being spaced apart from said cooking surface with its peripheral edge generally facing said cooking surface and defining with said cooking surface a gas capture region which includes the interior volume of said hood means and the volume between said cooking surface and said peripheral edge of said hood means, a source of air located remotely of said room, means defining an air inlet means located adjacent a substantial portion of the peripheral edge of said hood means and defining an opening through which air is introduced to said gas capture region first conduit means connecting said source of air in fluid communication with said air inlet means, first blower means disposed in position to move air from said source of air to and through said source of air to and through said air inlet means, filter means, means mounting said filter means within said gas capture region at a vertical height above said cooking surface less than the vertical height of said air inlet means above said cooking surface, and at a location substantially across said hood means from said air inlet means, flow directing means associated with said air inlet means directing at least a portion of the air from said air inlet means in a direction generally downwardly and outwardly from said air inlet means toward said filter means second conduit means connected in fluid communication with said filter means and terminating exteriorly of said room, and, second blower means disposed in position to move air through said second conduit means in a direction away from said filter means.

2. The system of claim 1 and including means associated with said air inlet means and defining a plurality of openings through which air is introduced in a plurality of streams to said space between said hood means and said cooking member.

3. The system of claim 1 wherein said air inlet means includes air flow control means directing said air entering said space between said hood means and said cooking member along a path that includes a section thereof which extends inwardly of said space and downwardly toward said filter, said section of said path terminating at said filter.

4. The system of claim 1 wherein the quantity of air exhausted through said filter is greater than the quantity of air entering said space between said hood means and said cooking surface via said air inlet means.

5. The system of claim 4 wherein said quantity of air exhausted through said filter exceeds by at least 10 percent the quantity of air entering said space between said hood means and said cooking surface.

* * * * *

UNITED STATES PATENT OFFICE

CERTIFICATE OF CORRECTION

Patent No. 4,146,017 Dated March 27, 1979

Inventor(s) Duncan E. Overton, Jr.

It is certified that error appears in the above-identified patent and that said Letters Patent are hereby corrected as shown below:

Column 2, line 34, "instruction" should be -- introduction --.

Column 7, line 6 and 7, delete "said source (second occurrence on line 6) of air to and through".

Signed and Sealed this

*Eighteenth* Day of *September 1979*

[SEAL]

*Attest:*

*Attesting Officer*

LUTRELLE F. PARKER

*Acting Commissioner of Patents and Trademarks*